US012392129B2

(12) United States Patent
Ochiai et al.

(10) Patent No.: US 12,392,129 B2
(45) Date of Patent: Aug. 19, 2025

(54) BUILDING AND METHOD FOR CONSTRUCTING BUILDING

(71) Applicant: Sekisui House, Ltd., Osaka (JP)

(72) Inventors: Makoto Ochiai, Osaka (JP); Kazuki Ichikawa, Osaka (JP); Masayuki Ogawa, Osaka (JP)

(73) Assignee: Sekisui House, Ltd., Osaka (JP)

( * ) Notice: Subject to any disclaimer, the term of this patent is extended or adjusted under 35 U.S.C. 154(b) by 301 days.

(21) Appl. No.: 18/019,652

(22) PCT Filed: Aug. 7, 2020

(86) PCT No.: PCT/JP2020/030315
§ 371 (c)(1),
(2) Date: Feb. 3, 2023

(87) PCT Pub. No.: WO2022/029989
PCT Pub. Date: Feb. 10, 2022

(65) Prior Publication Data
US 2023/0193620 A1 Jun. 22, 2023

(51) Int. Cl.
*E04B 1/38* (2006.01)
*E04B 7/02* (2006.01)
*E04B 1/26* (2006.01)

(52) U.S. Cl.
CPC ..... *E04B 1/388* (2023.08); *E04B 7/022* (2013.01); *E04B 1/2604* (2013.01); *E04B 2001/2648* (2013.01)

(58) Field of Classification Search
CPC ..... E04B 1/388; E04B 7/022
See application file for complete search history.

(56) References Cited

U.S. PATENT DOCUMENTS 3,967,908 A 7/1976 Snow et al.
4,073,109 A * 2/1978 Knutson ..... E04B 1/26 52/92.2
5,230,198 A 7/1993 Callies
6,354,055 B1 3/2002 Shaw et al.
(Continued)

FOREIGN PATENT DOCUMENTS

AU 2008233436 A1 5/2010
CN 102936966 A 2/2013
(Continued)

OTHER PUBLICATIONS

Japanese Office Action dated Jan. 16, 2024, in connection with Japanese Application No. 2022-541073.
(Continued)

*Primary Examiner* — Joshua K Ihezie
(74) *Attorney, Agent, or Firm* — Wolf, Greenfield & Sacks, P.C.

(57) ABSTRACT

This building comprises a foundation, a main building part that is provided to the foundation and that has a framework structure, and a roof that is provided to the main building part and that has a truss structure. Moreover, a method for constructing the building includes: a first step for forming the foundation; a second step for creating the main building part having a framework structure on the foundation; and a third step for attaching, to the main building part, a roof frame having a pre-assembled truss structure.

16 Claims, 7 Drawing Sheets

(56) References Cited

U.S. PATENT DOCUMENTS

| | | | | |
|---|---|---|---|---|
| 6,662,517 | B1 | 12/2003 | Thompson | |
| 6,691,478 | B2 * | 2/2004 | Daudet | E04B 5/14 52/262 |
| 7,716,899 | B2 * | 5/2010 | Beck | E04B 5/10 52/92.1 |
| 7,971,410 | B2 * | 7/2011 | Jerke | E04H 9/14 52/703 |
| 8,590,256 | B2 * | 11/2013 | Kawai | E04B 7/06 52/696 |
| 9,297,161 | B2 * | 3/2016 | Zimmerman | E04B 7/045 |
| 9,388,563 | B1 * | 7/2016 | Calini | E04C 3/17 |
| 9,650,780 | B2 * | 5/2017 | Tan | E04B 1/2608 |
| 9,777,479 | B2 * | 10/2017 | Rice | E04B 1/24 |
| 9,909,278 | B2 * | 3/2018 | Morton | E04B 1/0007 |
| 10,358,811 | B1 * | 7/2019 | Fox | E04B 1/2604 |
| 10,865,564 | B1 * | 12/2020 | Fuller | E04C 3/07 |
| 11,572,684 | B2 * | 2/2023 | Fox | E04B 1/2604 |
| 2002/0112439 | A1 | 8/2002 | Rosas | |
| 2003/0014928 | A1 | 1/2003 | Kerney | |
| 2007/0056244 | A1 | 3/2007 | Lawrence et al. | |
| 2009/0090082 | A1 * | 4/2009 | Kawai | E04B 7/024 52/712 |
| 2009/0178362 | A1 * | 7/2009 | Jerke | E04H 9/14 52/656.9 |
| 2011/0252724 | A1 * | 10/2011 | Heisler | E04D 13/0477 52/173.3 |
| 2013/0067851 | A1 * | 3/2013 | Zimmerman | E04B 1/2608 52/707 |
| 2014/0130442 | A1 | 5/2014 | Fuller et al. | |
| 2016/0258161 | A1 * | 9/2016 | Imai | E04B 1/26 |

FOREIGN PATENT DOCUMENTS

| | | | |
|---|---|---|---|
| DE | 30 10 126 | A1 | 10/1981 |
| DE | 37 38 103 | A1 | 5/1989 |
| DE | 20 2019 100 759 | U1 | 9/2019 |
| JP | H-01219230 | A | 9/1989 |
| JP | H06-4905 | U | 7/1994 |
| JP | 3030004 | U | 10/1996 |
| JP | H09-287234 | A | 11/1997 |
| JP | 2001-152561 | A | 6/2001 |
| JP | 2010-180654 | A | 8/2010 |
| JP | 2011-236696 | A | 11/2011 |
| JP | 2012097549 | A | 5/2012 |
| KR | 10-0595773 | B1 | 7/2006 |
| KR | 10-2017-0009223 | A | 1/2017 |

OTHER PUBLICATIONS

Australian Examination Report No. 4 dated Nov. 28, 2024, in connection with Australian Application No. 2020461882.

PCT/JP2020/030315, Sep. 29, 2020, International Search Report.

Japanese Office Action dated Jun. 4, 2024, in connection with Japanese Application No. 2022-541073, with English translation thereof.

International Search Report dated Sep. 29, 2020, in connection with International Application No. PCT/JP2020/030315.

JP 2022-541073, Jan. 16, 2024, Japanese Office Action.

* cited by examiner

BUILDING AND METHOD FOR CONSTRUCTING BUILDING

CROSS REFERENCE TO RELATED APPLICATIONS

This Application is a national stage filing under 35 U.S.C. 371 of International Patent Application Serial No. PCT/JP2020/030315, filed Aug. 7, 2020, entitled "BUILDING AND METHOD FOR CONSTRUCTING BUILDING." The entire content of this application is incorporated herein by reference in its entirety.

TECHNICAL FIELD

The present invention relates to a building and a method for constructing a building.

BACKGROUND ART

Patent Literature 1 discloses a building including a roof that has a truss structure. The roof having a truss structure is coupled to frame members (wall studs in the literature) of a wall.

CITATION LIST

Patent Literature

Patent Literature 1: U.S. Pat. No. 4,073,109

SUMMARY OF INVENTION

Technical Problem

To make the building more earthquake-resistant, reinforcement members are coupled to horizontal members or the wall. However, coupling the reinforcement members to the horizontal members or the wall in the building is time-consuming and reduces the construction efficiency. Thus, a building and a method for constructing a building capable of reducing the number of reinforcement members are provided.

Solution to Problem (1) A building that solves the problem includes a foundation, a building body arranged on the foundation, the building body having a Rahmen structure, and a roof arranged on the building body, the roof having a truss structure.

In this configuration, the roof having a truss structure is coupled to the building body having a Rahmen structure.

This limits situations in which the upper part of the building body are distorted by shaking of the ground, and thus limits distortion of the entire building. Accordingly, the building body has fewer reinforcement members.

(2) In the building according to (1), the building body includes vertical members, first horizontal members extending between the vertical members, and second horizontal members extending between the first horizontal members, the second horizontal members intersecting the first horizontal members. The roof includes roof frames fixed to the first horizontal members or the second horizontal members using a metal fitting. The roof frames each include a roof extending member spanning two of the first horizontal members or two of the second horizontal members, rafters coupled to the roof extending member, and a reinforcement member arranged so as to form a truss structure in an outer frame that is defined by the roof extending member and the rafters. The roof frames are fixed to the first horizontal members or the second horizontal members using the metal fitting.

In this configuration, two structures including the first horizontal members are coupled to each other by the roof frames. Alternatively, two structures including the second horizontal members are coupled to each other by the roof frames. This limits situations in which the entire building is distorted by shaking of the ground.

(3) In the building according to (2), one or more frame members are arranged between two of the vertical members. This configuration reinforces the wall that includes the vertical members.

(4) In the building according to (3), the frame members are each formed using dimensional lumbers that have a smaller cross-sectional area than the vertical members, the first horizontal members, and the second horizontal members. This configuration lowers the costs of the frame members.

(5) A method for constructing a building that solves the problem includes a first step that forms a foundation, a second step that forms a building body on the foundation, the building body having a Rahmen structure, and a third step that couples a pre-assembled roof frame to the building body, the roof having a truss structure. In this configuration, the pre-assembled roof frame lowers the amount of work at a construction site and shortens the construction period.

Advantageous Effects of Invention

The building has fewer reinforcement members.

DESCRIPTION OF EMBODIMENTS

A building will now be described with reference to FIGS. 1 to 14. The building of the present embodiment has two floors. FIG. 2 shows the skeleton frame of the first-floor section of a building 1. FIG. 2 does not show reinforcement members 63 at a floor 60 that is located between the first and second floors.

Figure 1:
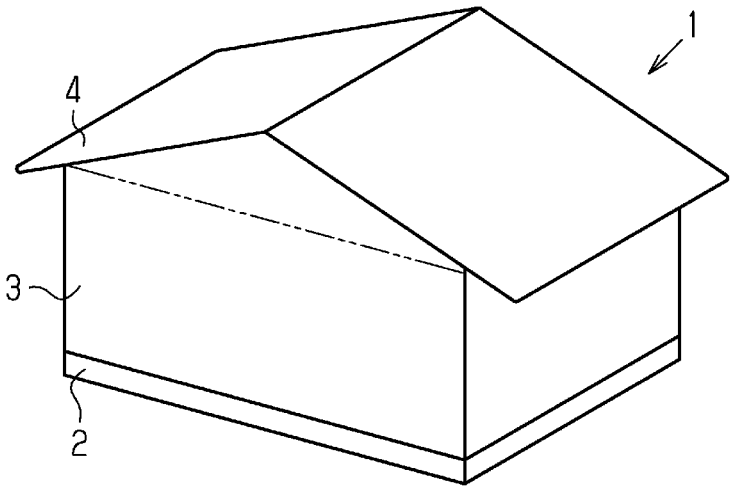
FIG. 1 is a schematic diagram showing a building.
Figure 2:
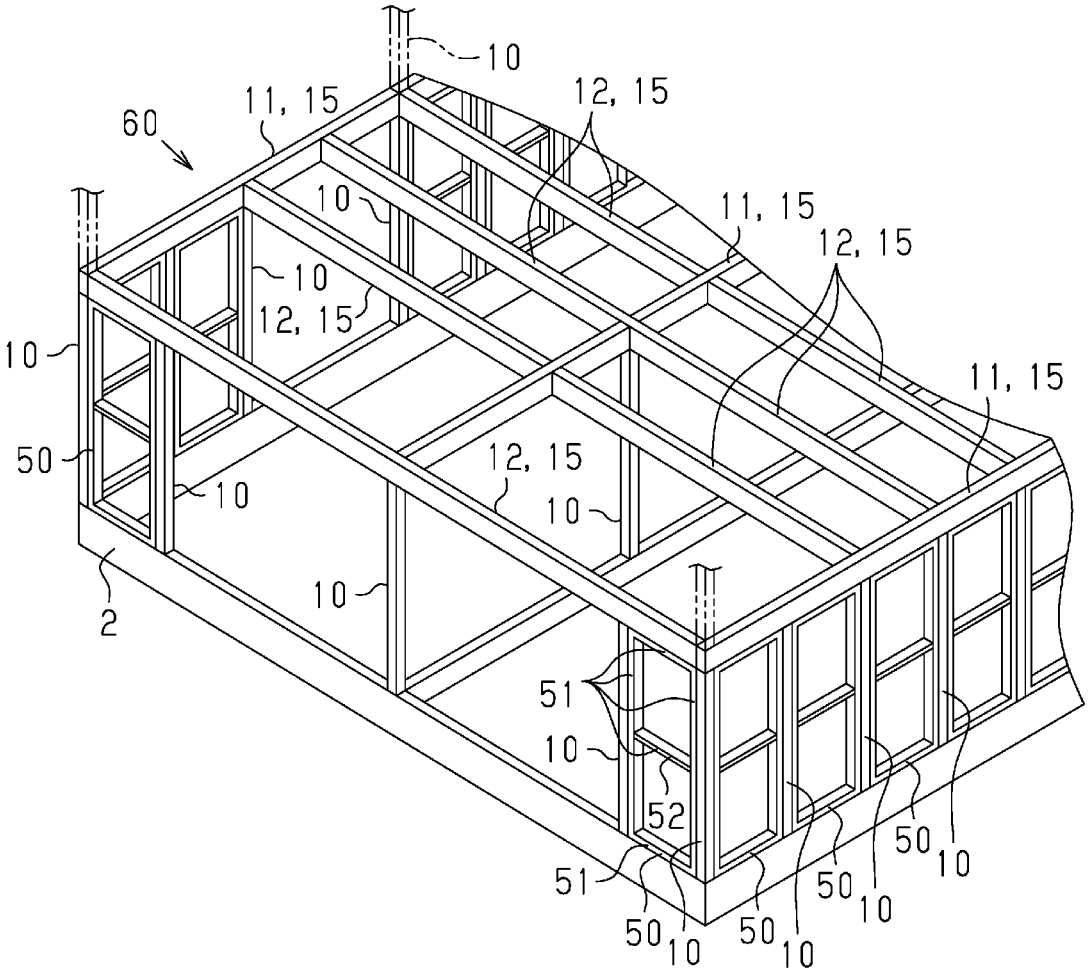
FIG. 2 is a perspective view showing the skeleton frame of the building body.

As shown in FIG. 1, the building 1 includes a foundation 2, a building body 3, and a roof 4. The building 1 of the present embodiment has multiple floors. The foundation 2 is arranged on the ground. The foundation 2 is made of, for example, reinforced concrete. The building body 3 is arranged on the foundation 2.

As shown in FIG. 2, the building body 3 has a Rahmen structure. More specifically, the building body 3 includes vertical members 10, first lateral members 11, and second horizontal members 12. The vertical members 10 are also referred to as posts. The vertical members 10 are made of wood. The vertical members 10 are arranged upright on the foundation 2 using foundation metal fittings 20.

The vertical members 10 may have a length extending over multiple floors. The vertical members 10 may have a length equivalent to the height of one floor. The lower end face of each vertical member 10 includes a slit 10*c* into which a plate 23 of the corresponding foundation metal fitting 20 is inserted. The slit 10*c* extends from an end face 10*a* of the vertical member 10 in a longitudinal direction of the vertical member 10. Thus, the inner surface of the slit 10*c* is arranged with the grain of the vertical member 10. This limits a decrease in the strength of a portion branched by the slit 10*c*. Slits 11*c*, 12*b*, which will be described below, have the same structure. That is, in a member including the slit 11*c* and a member including the slit 12*b*, the slits 11*c*, 12*b* each extend in a longitudinal direction of the corresponding member from its end face perpendicular to the longitudinal direction of the member.

Figure 3:
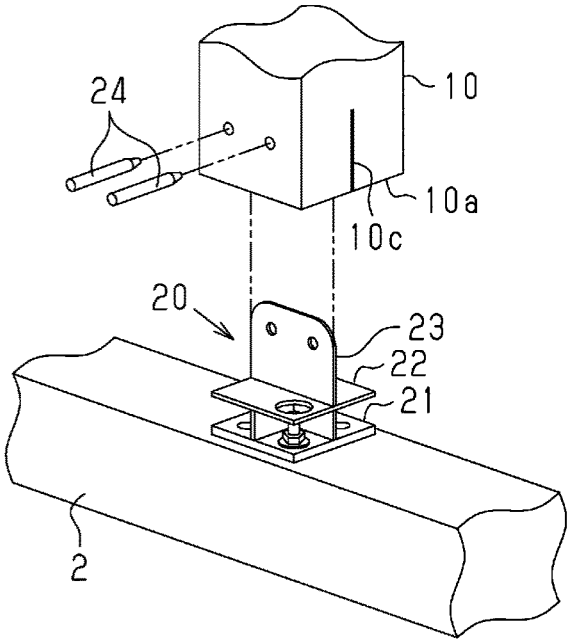
FIG. 3 is a perspective view showing the foundation metal fitting.

As shown in FIG. 3, the foundation metal fitting 20 includes a fixed portion 21 fixed to the foundation 2, a receiving portion 22 located above the fixed portion 21, and the plate 23 extending upward from the receiving portion 22. The receiving portion 22 receives the end face 10*a* of the vertical member 10. The fixed portion 21 of the foundation metal fitting 20 is fixed to the foundation 2 using a bolt. The plate 23 of the foundation metal fitting 20 is fixed to the vertical member 10 using drift pins 24. The drift pins 24 are inserted into the vertical member 10 so as to extend through the plate 23 and the vertical member 10 in a state of being placed in the slit of the vertical member 10.

Each first horizontal member 11 extends between and/or across multiple vertical members 10. The first horizontal member 11 is a longitudinal beam or a transverse beam. In one example, the first horizontal member 11 is arranged such that a side surface 11*b* of the first horizontal member 11 is in contact with the end face 10*a* of the vertical member 10 (see FIG. 4). In another example, the first horizontal member 11 is arranged such that an end face of the first horizontal member 11 is in contact with a side surface 10*b* of the vertical member 10. In a further example, the first horizontal member 11 is arranged such that the end face of the first horizontal member 11 is in contact with a side surface of the second horizontal member 12.

The second horizontal members 12 intersect the first horizontal members 11. Each second horizontal member 12 extends between and/or across multiple first lateral members 11. The second horizontal member 12 is a longitudinal beam or a transverse beam. In one example, the second horizontal member 12 is arranged such that an end face 12*a* of the second horizontal member 12 is in contact with the side surface 11*b* of the first horizontal member 11 (see FIG. 5). In another example, the second horizontal member 12 is arranged such that the end face 12*a* of the second horizontal member 12 is in contact with the side surface 10*b* of the vertical member 10.

The vertical members 10 are coupled to the first horizontal members 11 using coupling metal fittings. The first horizontal members 11 are coupled to the second horizontal members 12 using coupling metal fittings. The vertical members 10 are coupled to the second horizontal members 12 using coupling metal fittings. Examples of the coupling metal fittings include first to third coupling metal fittings 30 to 40, which will be described below.

Figure 4:
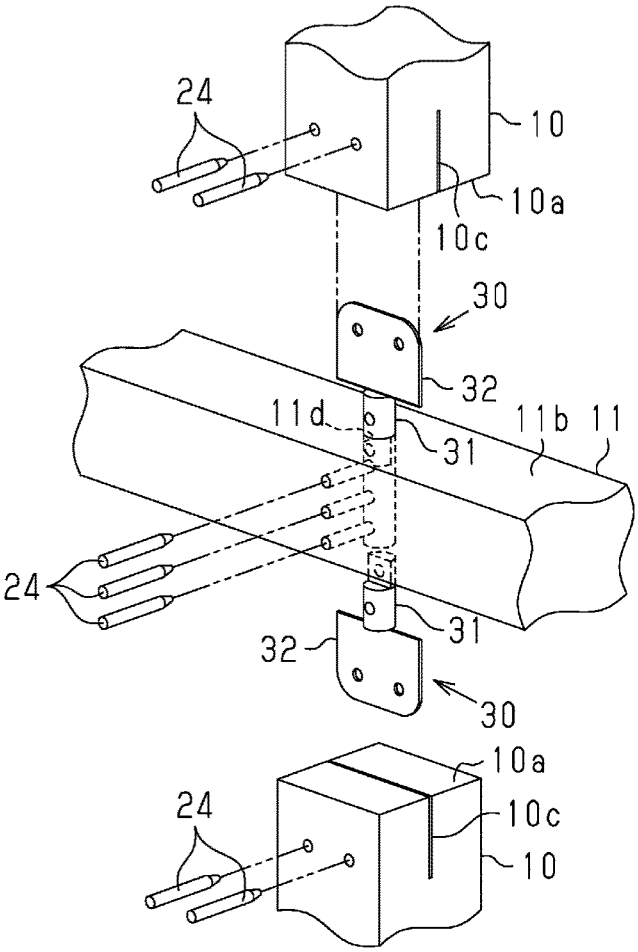
FIG. 4 is a perspective view showing the first coupling metal fitting.

As shown in FIG. 4, the first coupling metal fitting 30 couples the vertical member 10 to the first horizontal member 11. The first coupling metal fitting 30 may couple the vertical member 10 to the second horizontal member 12.

The first coupling metal fitting 30 includes a tenon protrusion 31 and a plate 32 on the tenon protrusion 31. The tenon protrusion 31 is configured to be fitted to a tenon hole 11*d* of the first horizontal member 11. The plate 32 is configured to be inserted into the slit 10*c* of the vertical member 10. The tenon protrusion 31 is fixed to the first horizontal member 11 using drift pins 24. The plate 32 is fixed to the vertical member 10 using drift pins 24.

Figure 5:
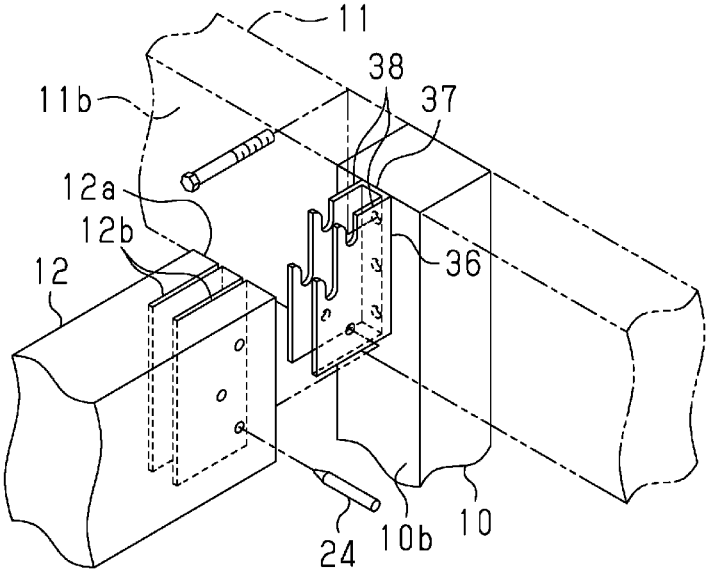
FIG. 5 is a perspective view showing the second coupling metal fitting.

As shown in FIG. 5, the second coupling metal fitting 36 couples the second horizontal member 12 to the vertical member 10. The second coupling metal fitting 36 may couple the second horizontal member 12 to the first horizontal member 11.

The second coupling metal fitting 36 includes a fixed portion 37 that is fixed to the vertical member 10 or the first horizontal member 11 and a plate 38 that extends from the fixed portion 37. The fixed portion 37 is fixed to the side surface 10*b* of the vertical member 10 or the side surface 11*b* of the first horizontal member 11 using a bolt. The plate 38 is configured to be inserted into the slit 12*b* of the second horizontal member 12. The plate 38 is fixed to the second horizontal member 12 using a drift pin 24.

Figure 6:
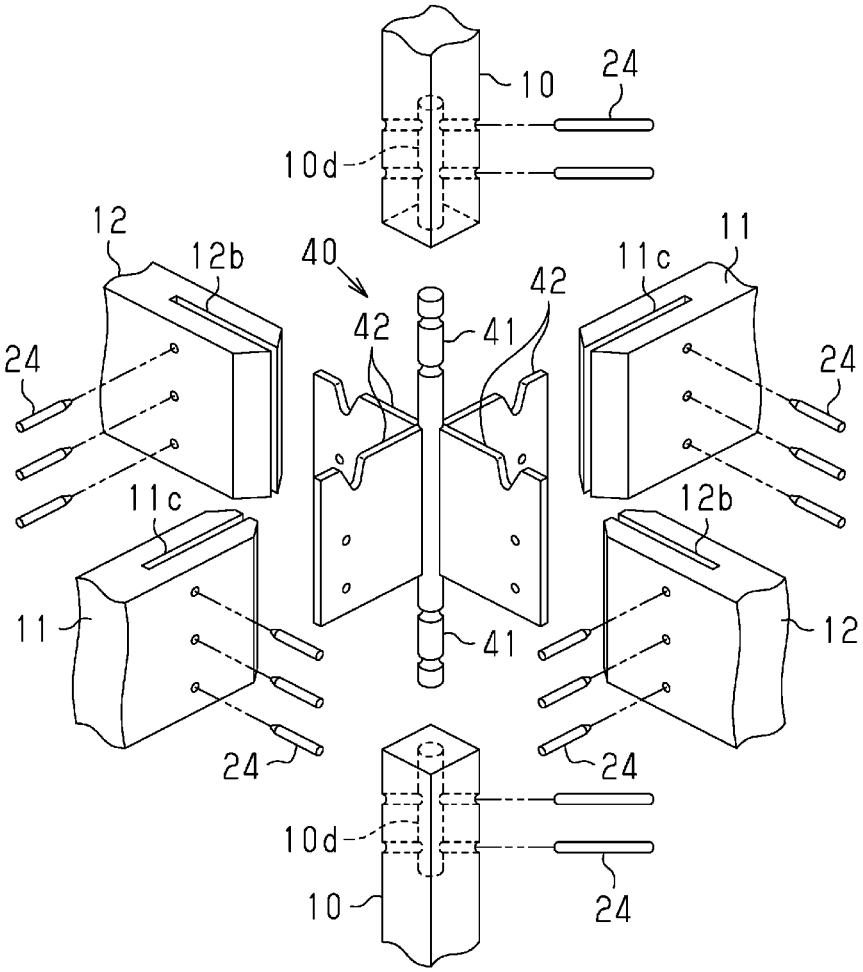
FIG. 6 is a perspective view showing the third coupling metal fitting.

As shown in FIG. 6, the third coupling metal fitting 40 couples two (upper and lower) vertical members 10, the first horizontal member 11, and the second horizontal member 12 to each other. The third coupling metal fitting 40 includes a shaft 41 and plates 42 that extend from the shaft 41. The first end of the shaft 41 is configured to be inserted into a tenon hole 10*d* of the upper vertical member 10. The second end of the shaft 41 is configured to be inserted into a tenon hole 10*d* of the lower vertical member 10. The plates 42 are located on an intermediate portion of the shaft 41. The number of plates 42 in the third coupling metal fitting 40 corresponds to the number of horizontal members that are to be coupled to each other. The plates 42 are configured to be inserted into the slit 11*c* of the first horizontal member 11 or the slit 12*b* of the second horizontal member 12. The plates 42 are fixed to the first horizontal member 11 or the second horizontal member 12 using drift pins 24.

As shown in FIG. 2, the building 1 includes frame members 50.

Each frame member 50 reinforces a wall having a Rahmen structure. The wall includes two vertical members 10 and a first horizontal member 11 or a second horizontal member 12 that extends between and/or across the two vertical members 10. One or more frame members 50 are arranged between two of multiple vertical members 10. Preferably, the thickness of each frame member 50 is equal to that of the wall structure.

Each frame member 50 is defined by dimensional lumbers 51. The cross-sectional area of each dimensional lumber 51 has a smaller cross-sectional area than those of the vertical member 10, the first horizontal member 11, and the second horizontal member 12. The frame member 50 is shaped into a rectangular frame using the dimensional lumbers 51. Each dimensional lumber 51 is made of wood in which the ratio of height to width is pre-defined in the market of woods used for construction. For example, in the cross-section of the dimensional lumber 51, the height is twice as long as the width. The thickness of the frame member 50 is equal to the height of the dimensional lumber 51.

The upper part of the frame member 50 is fixed to the first horizontal member 11 or the second horizontal member 12 using screws or bolts. The two sides of the frame member 50 are fixed to the vertical members 10 using screws or bolts. Preferably, the two sides of the frame member 50 are coupled using a coupling member 52. The coupling member 52 is arranged between the two sides and connected to each of the two sides.

Figure 7:
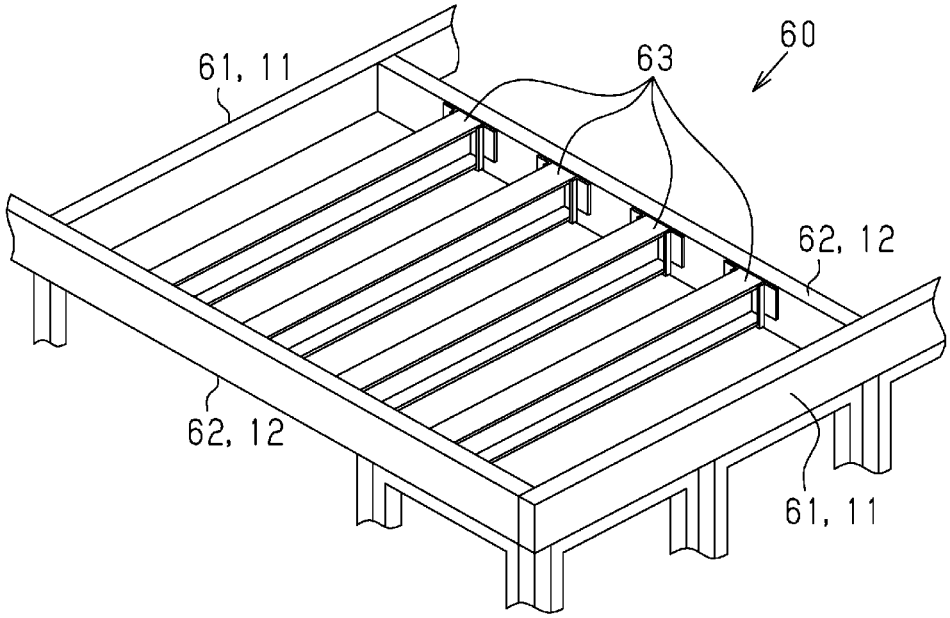
FIG. 7 is a perspective view showing the floor.

As shown in FIG. 7, the building 1 includes the floor 60 located between the upper and lower floors. The floor 60 is reinforced by the reinforcement members 63.

The upper floor means a floor that is a level above the lower floor. For example, the floor 60 is located between the first and second floors. In another example, the floor 60 is located between the second and third floors. In a further example, the floor 60 is located between the first underground floor and the ground floors. In the present embodiment, the building 1 has two floors. The building 1 includes the floor 60 located between the first and second floors.

The floor 60 includes first floor extending members 61 and second floor extending members 62 that intersect the first floor extending members 61. The first floor extending member 61 corresponds to one of the first horizontal member 11 and the second horizontal member 12 in the Rahmen structure. The second floor extending member 62 corresponds to the other one of the first horizontal member 11 and the second horizontal member 12 in the Rahmen structure.

The first floor extending member 61 and the second floor extending member 62 are made of wood. The reinforcement members 63 may be arranged between two first floor extending members 61. The reinforcement members 63 may be arranged between two second floor extending members 62.

Figure 8:
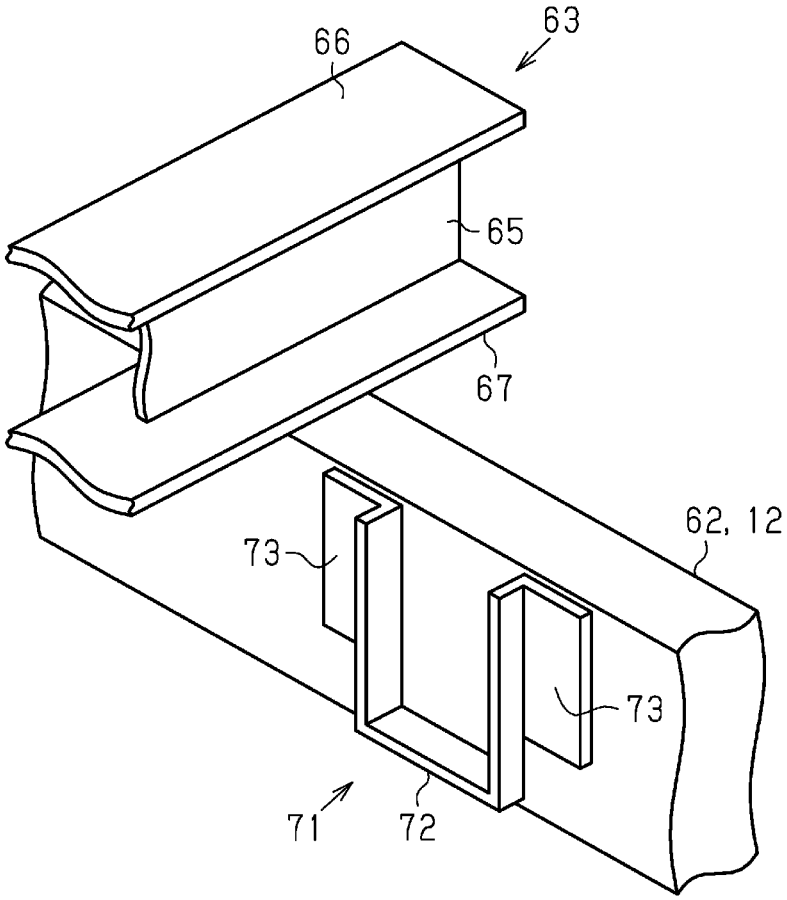
FIG. 8 is an exploded perspective view showing the floor.

As shown in FIG. 8, the reinforcement member 63 includes a plate-shaped body 65, an upper flange 66, and a lower flange 67. The upper flange 66 is formed using a plate member. The upper flange 66 is located at the upper part of the body 65 so as to intersect the body 65. The lower flange 67 is formed using a plate member. The lower flange 67 is located at the lower part of the body 65 so as to intersect the body 65.

As shown in FIG. 7, the reinforcement members 63 are arranged between two second floor extending members 62 in the present embodiment. The two second floor extending members 62 each include support metal fittings 71 that support ends of the reinforcement members 63. The reinforcement members 63 are supported by the support metal fittings 71 that are arranged at each of the two second floor extending members 62. More specifically, the opposite ends of the reinforcement member 63 are respectively supported by the support metal fittings 71 from below. An end of the reinforcement member 63 is mounted on a support receiving portion 72 of each support metal fitting 71. The end of the reinforcement member 63 is not fixed to the support metal fitting 71. The end of the reinforcement member 63 is not fixed to the second floor extending member 62. The reinforcement member 63 is arranged such that the end face of the reinforcement member 63 faces the side surface of the second floor extending member 62. A gap may be provided between the end face of the reinforcement member 63 and the side surface of the second floor extending member 62. When the building body 3 shakes, the reinforcement member 63 contacts the side surface of the second floor extending member 62. This limits deformation of the Rahmen structure including the first floor extending members 61 and the second floor extending members 62. A flooring material is arranged on the reinforcement members 63. The reinforcement members 63 limits flexing of the flooring material.

As shown in FIG. 8, the support metal fitting 71 is configured to accommodate an end of the reinforcement member 63. The support metal fitting 71 includes the support receiving portion 72 and fixed portions 73. The support receiving portion 72 supports the lower part of the end of the reinforcement member 63. The fixed portions 73 extends from opposite ends of the support receiving portion 72, respectively. The two fixed portions 73 are fixed to the first floor extending member 61 or the second floor extending member 62 using screws. The distance between the two fixed portions 73 is set such that the reinforcement member 63 can be inserted therebetween.

The first floor extending member 61, the second floor extending member 62, and the reinforcement member 63 are arranged such that their upper surfaces are flat surfaces flush with each other. This allows for the construction of a flat floor surface that includes the upper surfaces of the first floor extending member 61 and the floor extending member 62.

Figure 9:
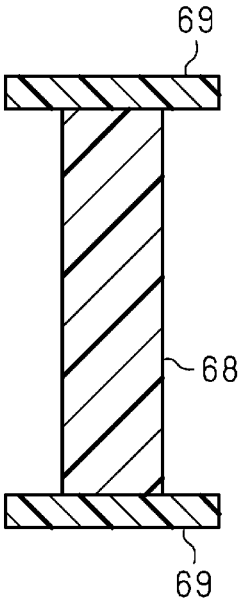
FIG. 9 is a cross-sectional view showing the reinforcement member.

As shown in FIG. 9, the cross-section of the reinforcement member 63 is shaped so as to include a first portion 68 and second portions 69. The first portion 68 extends vertically. The second portions 69 are arranged on opposite sides of the first portion 68, respectively, and intersect the first portion 68. The first portion 68 corresponds to the body 65. The upper second portion 69 on the upper side of the first portion 68 corresponds to the upper flange 66. The lower second portion 69 on the lower side of the first portion 68 corresponds to the lower flange 67.

Figure 10:
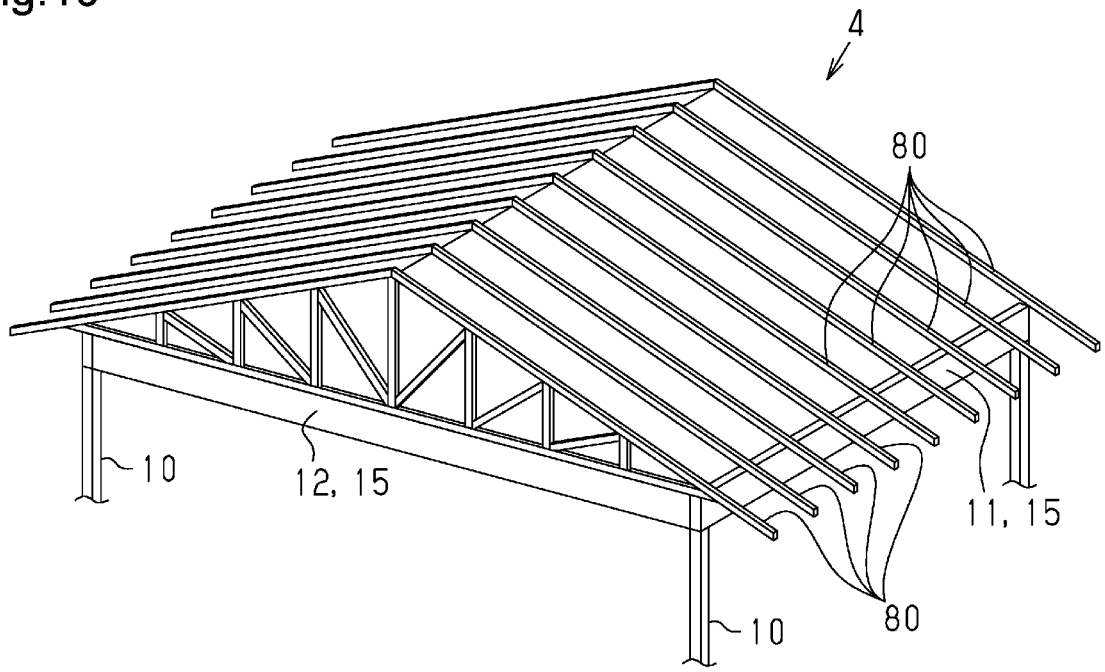
FIG. 10 is a perspective view showing the roof.

The roof 4 will now be described with reference to FIGS. 10 to 14. The roof 4 is arranged on the building body 3. The roof 4 has a truss structure. As shown in FIG. 10, the roof 4 includes roof frames 80. In the present embodiment, the roof frames 80 each have a truss structure.

The roof frames 80 are arranged in parallel on the building body 3. Preferably, the roof frames 80 are arranged at equal intervals. The roof frames 80 may be connected to each other by a coupling member 84 (see FIG. 13).

Figure 11:
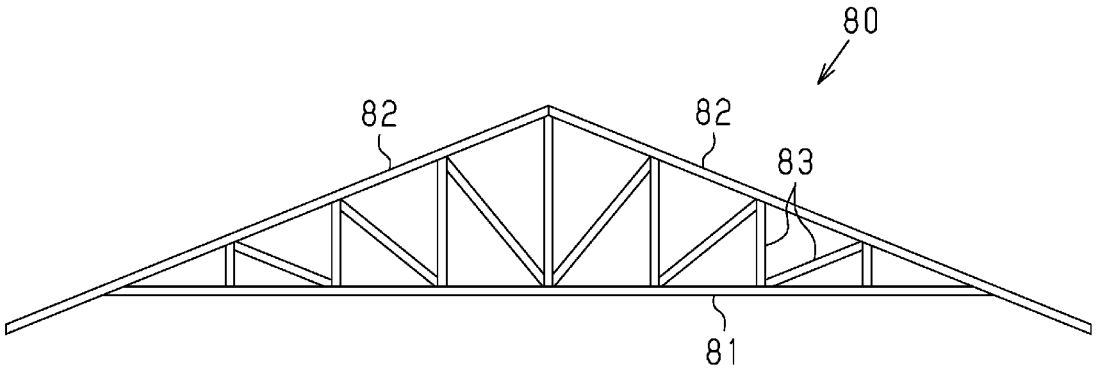
FIG. 11 is a side view showing the roof frame.

As shown in FIG. 11, the roof frame 80 includes a roof extending member 81, rafters 82, reinforcement members 83.

The roof extending member 81 spans two first horizontal members 11 or two second horizontal members 12. The rafters 82 are coupled to the roof extending member 81. In the present embodiment, the first ends of the two rafters 82 are coupled to each other so as to form a corner that has a predetermined angle. The second ends of the two rafters 82 are spaced apart from each other. The first end of the roof extending member 81 is coupled to a portion near the second end of one of the two rafters 82. The second end of the roof extending member 81 is coupled to a portion near the second end of the other one of the two rafters 82. The roof extending member 81 and the two rafters 82 define an outer frame of the roof frame 80. The reinforcement members 83 are coupled to the outer frame of the roof frame 80 such that a truss structure is formed in the outer frame of the roof frame 80.

Preferably, the roof extending member 81, the rafters 82, and the reinforcement members 83 are formed using the dimensional lumbers 51. The use of the dimensional lumbers 51 allows the roof frame 80 to have a standard thickness. When the roof frame 80 has a standard thickness, metal fittings being marketed can be used to fix the roof frame 80 to two first horizontal members 11 or two second horizontal members 12.

The roof frame 80 is fixed to the first horizontal member 11 or the second horizontal member 12 using metal fittings. One of the first horizontal member 11 and the second horizontal member 12 to which the roof frame 80 is fixed is hereinafter referred to as the roof horizontal member 15. The roof horizontal member 15, to which the roof frame 80 is fixed, is preferably thicker than a dimensional lumber. For example, the roof horizontal member 15, to which the roof frame 80 is fixed, has a cross-sectional area greater than that of the dimensional lumber. The roof horizontal member 15, to which the roof frame 80 is fixed, may be formed using a laminated wood.

Examples of the metal fittings include a first metal fitting 91 and a second metal fitting 95, which will be described below. The first metal fitting 91 and the second metal fitting 95 each fix the roof extending member 81 of the roof frame 80 to the roof horizontal member 15 at a portion where the roof extending member 81 of the roof frame 80 intersects the roof horizontal member 15.

Figure 12:
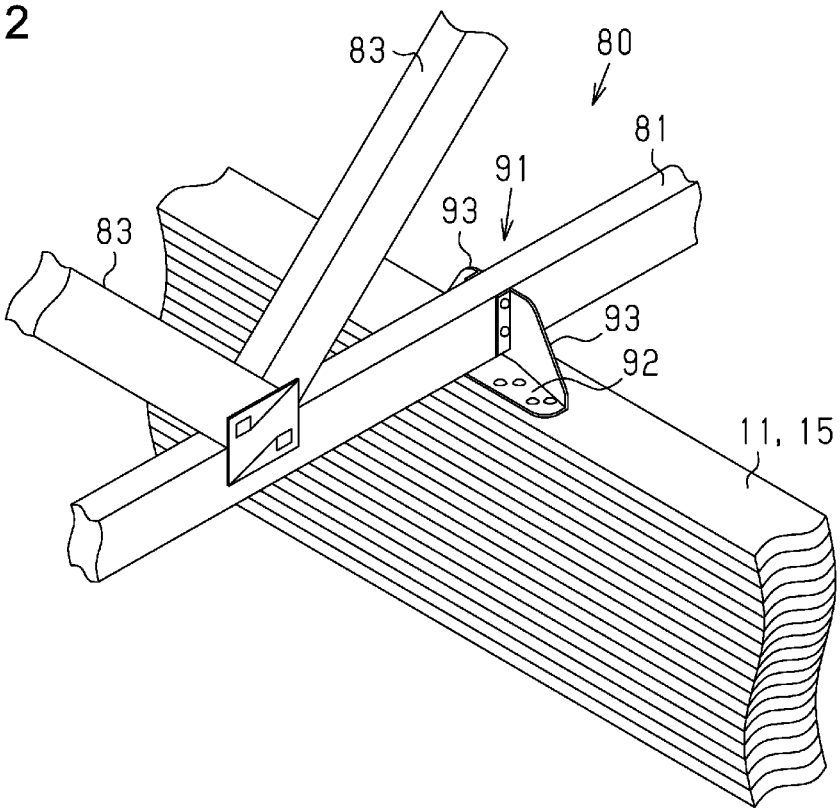
FIG. 12 is a perspective view showing a portion where the roof frame is coupled to the roof horizontal member.

As shown in FIG. 12, the first metal fitting 91 includes a fixed portion 92 and two tabs 93 that sandwich the roof extending member 81. The fixed portion 92 is fixed to the roof horizontal member 15. The two tabs 93 protrude from the fixed portion 92.

Figure 13:
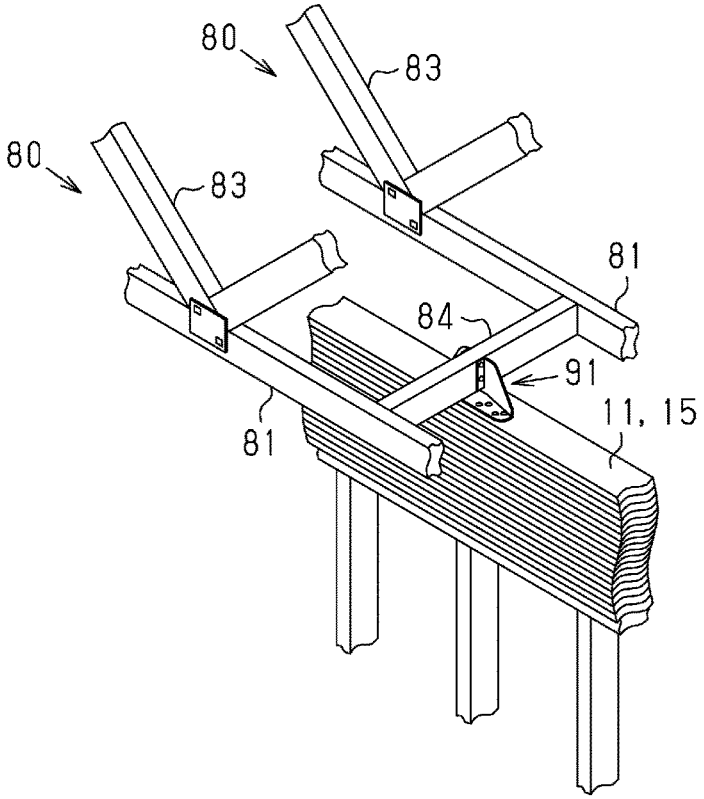
FIG. 13 is a perspective view showing a portion where the roof frame is coupled to the roof horizontal member.

As shown in FIG. 13, the first metal fitting 91 may fix the coupling member 84, which couples two roof frames 80 to each other, to the roof horizontal member 15. More specifically, the first metal fitting 91 is arranged on the roof horizontal member 15 to sandwich the coupling member 84 at a portion where the coupling member 84 intersects the roof horizontal member 15.

Figure 14:
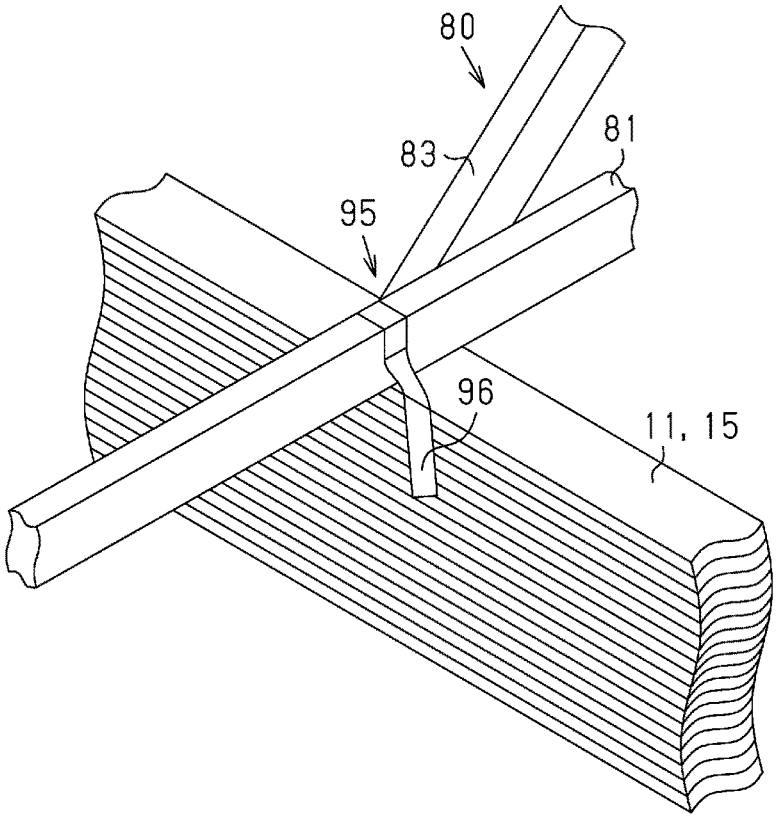
FIG. 14 is a perspective view showing a portion where the roof frame is coupled to the roof horizontal member.

As shown in FIG. 14, the second metal fitting 95 is an elongated metal plate. The second metal fitting 95 is hooked in contact with the upper surface of the roof extending member 81. Two opposite ends 96, 96 of the second metal fitting 95 are fixed to the roof horizontal member 15.

The method for constructing the building 1 will now be described.

The method for constructing the building 1 includes first to third steps. In the first step, the foundation 2 is formed. In the second step, the building body 3 having a Rahmen structure is formed on the foundation 2.

In the third step, pre-assembled roof frames 80 each having a truss structure are coupled to the building body 3. More specifically, each roof frame 80 includes rafters 82 and a roof extending member 81. The roof frames 80 are arranged on the building body 3 such that the roof extending members 81 extend between and/or across the roof horizontal members 15. The roof extending members 81 of the roof frames 80 are fixed to the roof horizontal members 15 of the building body 3 using metal fittings.

The method for constructing the building 1 may include a fourth step. In the fourth step, pre-assembled frame members 50 are used to reinforce a wall having a Rahmen structure. The fourth step may be performed in the second step or in the third step. More specifically, one or more frame members 50 are fitted between two vertical members 10, and the frame members 50 are fixed to the vertical members 10 using screws.

The method for constructing the building 1 may include a fifth step. In the fifth step, the reinforcement members 63 reinforce the floor 60 having a Rahmen structure. The fifth step may be performed in the second step or in the third step. For example, the support metal fitting 71 is coupled to each of the two second floor extending members 62 of the floor 60. The two support metal fittings 71 face each other. Each reinforcement member 63 is arranged on the space between the two support metal fittings 71, and the ends of the reinforcement members 63 are inserted into the support metal fittings 71 with the reinforcement members 63 brought down. In this manner, the reinforcement member 63 is arranged between the two second floor extending members 62.

The operation of the present embodiment will now be described.

In conventional construction, the skeleton frames of the building body 3 and the roof 4 are constructed using posts, beams, and the like. The lower part of the building body 3 is fixed to the foundation 2. The roof 4 is arranged on the upper part of the building body 3. Due to such a configuration, when the building body 3 shakes, the lower part of the building body 3 may deform to a greater extent than the upper part of the building body 3. To limit situations in which the upper part of the building body 3 is deformed by the shaking, reinforcement members (angle braces) are arranged at the corners of the first horizontal member 11 and the second horizontal member 12 that intersect each other. Alternatively, reinforcement members (cross braces) that diagonally intersect two vertical members 10 supporting the roof 4 may be arranged between the two vertical members 10. The arrangement of such reinforcement members is time-consuming and thus lengthens the construction period.

In the building 1 of the present embodiment, the roof 4 has a truss structure. This allows the upper part of the building body 3 to be fixed to the roof 4 having a truss structure, and thus limits situations in which the upper part of the building body 3 are deformed by shaking. Accordingly, the building body 3 has fewer reinforcement members. Thus, the arrangement of such reinforcement members in the building body 3 saves time.

The present embodiment has the following advantages.

(1) The building 1 includes the foundation 2, the building body 3, which has a Rahmen structure, and the roof 4, which has a truss structure. In this configuration, the roof 4 having a truss structure is coupled to the building body 3 having a Rahmen structure. This limits situations in which the upper part of the building body 3 are distorted by shaking of the ground, and thus limits distortion of the entire building 1. Accordingly, the building body 3 has fewer reinforcement members.

(2) The building body 3 includes the vertical members 10, the first lateral members 11, and the second horizontal members 12, which extend between the first lateral members 11. The roof 4 includes the roof frames 80. Each roof frame 80 is fixed to the first horizontal member 11 or the second horizontal member 12 using metal fittings. The roof frame 80 includes the reinforcement members 83, which are arranged such that a truss structure is formed in the outer frame defined by the roof extending member 81 and the rafters 82. The roof frame 80 is fixed to the first horizontal member 11 or the second horizontal member 12 using metal fittings.

In this configuration, two structures including the first horizontal members 11 are coupled to each other by the roof frames 80. Alternatively, two structures including the second horizontal members 12 are coupled to each other by the roof frames 80. This limits situations in which the entire building 1 is distorted by shaking of the ground.

(3) Preferably, one or more frame members 50 are arranged between two of the vertical members 10. This configuration reinforces the wall that includes the vertical members 10.

(4) Preferably, the frame members 50 are formed using the dimensional lumbers 51, which have a smaller cross-sectional area than the vertical members 10, the first horizontal members 11, and the second horizontal members 12. This configuration lowers the costs of the frame members 50.

(5) The vertical members 10 may be fixed to the foundation 2 using the foundation metal fittings 20. The vertical members 10 include the slits 10*c*. Each foundation metal fitting 20 includes the plate 23, which is inserted into the slit 10*c*, and the fixed portion 21, which is fixed to the foundation 2. This configuration allows the vertical members 10 to be strongly fixed to the foundation 2.

(6) The vertical member 10 and the first horizontal member 11 may be coupled to each other by the first coupling metal fitting 30 (see FIG. 4). The vertical members 10 include the slits 10*c*, respectively. The first horizontal member 11 includes the tenon hole 11*d*. The first coupling metal fitting 30 includes the tenon protrusion 31, which is inserted into the tenon hole 11*d*, and the plate 32, which is inserted into the slit 10*c*. This configuration allows the first horizontal member 11 to be strongly coupled to the vertical member 10.

(7) The vertical member 10 and the second horizontal member 12 may be coupled to each other by the first coupling metal fitting 30. The vertical members 10 include the slits 10*c*, respectively. The second horizontal member 12 includes a tenon hole. The first coupling metal fitting 30 includes the tenon protrusion 31, which is inserted into the tenon hole, and the plate 32, which is inserted into the slit 10*c*. This configuration allows the second horizontal member 12 to be strongly coupled to the vertical member 10.

(8) The first horizontal member 11 and the second horizontal member 12 may be coupled to each other by the second coupling metal fitting 36 (see FIG. 5). The second horizontal member 12 includes the slit 12*b*. The second coupling metal fitting 36 includes the fixed portion 37 and the plate 38, which is inserted into the slit 12*b*. This configuration allows the second horizontal member 12 to be strongly coupled to the first horizontal member 11.

(9) The vertical member 10, the first horizontal member 11, and the second horizontal member 12 may be coupled to each other by the third coupling metal fitting 40 (see FIG. 6). The vertical member 10 includes the tenon hole 10*d*. The first horizontal member 11 includes the slit 11*c*. The second horizontal member 12 includes the slit 12*b*. The third coupling metal fitting 40 includes the shaft 41, which is inserted into the tenon hole 10*d* of the vertical member 10, and the plates 42, which are respectively inserted into the slits 11*c*, 12*b*. This configuration allows the vertical member 10, the first horizontal member 11, and the second horizontal member 12 to be strongly coupled to each other.

(10) The method for constructing the building 1 includes the first step, which forms the foundation 2, the second step, which forms the building body 3 having a Rahmen structure on the foundation 2, and the third step, which couples pre-assembled roof frames 80 each having a truss structure to the building body 3. In this configuration, since the roof frames 80 are pre-assembled, the amount of work at a construction site is lowered. As a result, the construction period is shortened.

(11) The method for constructing the building 1 further includes the fourth step, which reinforces a wall having a Rahmen structure using pre-assembled frame members 50. The fourth step may be performed in the second step or in the third step. The frame members 50 are pre-assembled. At a construction site, the building body 3 is thus reinforced only by coupling the frame members 50 to the building body 3.

Modifications

The above-described embodiment exemplifies, without any intention to limit, an applicable form of a building and a method for constructing a building. The building 1 exemplified in the embodiment can take a form different from that illustrated in the embodiment. For example, some of the components of the embodiment may be replaced, changed, or omitted. Alternatively, another component may be added to the embodiment. Modifications of the embodiment will now be described.

In the building 1 of the present embodiment, the vertical members 10 is arranged upright on the foundation 2. Instead, the vertical members 10 may be arranged upright on a base that is arranged on the upper side of the foundation 2.

The roof frames 80 may be coupled to the roof horizontal members 15 using metal fittings that are similar to the first coupling metal fittings 30 or the second coupling metal fittings 36.

REFERENCE SIGNS LIST

1) Building; 2) Foundation; 3) Building Body; 4) Roof; 10) Vertical Member; 11) First Horizontal Member; 12) Second Horizontal Member; 50) Frame Member; 51) Dimensional Lumber; 63) Reinforcement Member; 80) Roof Frame; 81) Roof Extending Member; 82) Rafter

The invention claimed is:

1. A building, comprising:

a foundation;

a building body arranged on the foundation, the building body having a Rahmen structure;

a roof arranged on the building body, the roof having a truss structure; and metal fittings, wherein:

the building body includes:

vertical members;

first horizontal members extending between the vertical members; and second horizontal members extending between the first horizontal members, the second horizontal members intersecting the first horizontal members, the roof includes roof frames, at least one roof frame includes:

a roof extending member spanning two of the first horizontal members or two of the second horizontal members;

rafters coupled to the roof extending member; and a reinforcement member arranged so as to form the truss structure in an outer frame that is defined by the roof extending member and the rafters, the at least one roof frame is fixed to at least one first horizontal member or at least one second horizontal member using at least one metal fitting, the at least one metal fitting includes a fixed portion, two tabs and an attachment portion, the fixed portion is configured to extend away from the at least one roof frame along an upper surface of the at least one first horizontal member or the at least one second horizontal member to which the at least one roof frame is fixed, the fixed portion includes a first edge portion and a second edge portion, and is fixed to the at least one first horizontal member or the at least one second horizontal member to which the at least one roof frame is fixed, the first edge portion includes an inclined portion that is inclined with respect to an extending direction of the at least one first horizontal member or the at least one second horizontal member to which the fixed portion is fixed, the two tabs protrude from the inclined portion of the fixed portion and sandwich the roof extending member, a distance between the inclined portion and the second edge portion narrows as a distance from the roof extending member sandwiched by the two tabs increases, the attachment portion is configured to extend in one direction from each of the two tabs along the roof extending member sandwiched by the two tabs, and at a portion where the roof extending member intersects the at least one first horizontal member or the at least one second horizontal member, the at least one metal fitting fixes the roof extending member to the at least one first horizontal member or the at least one second horizontal member.

2. The building according to claim 1, wherein:

the building body further includes one or more frame members arranged between two of the vertical members, and each of the one or more frame members with a rectangular frame shape includes a top portion, a bottom portion, and opposing side portions.

3. The building according to claim 2, wherein each of the one or more frame members is formed using dimensional lumber that has a smaller cross-sectional area than the vertical members, the first horizontal members, and the second horizontal members.

4. The building according to claim 2, wherein:

each of the one or more frame members has a space defined by the top portion, the bottom portion, and the opposing side portions, each of the opposing side portions is in contact with at least one of the vertical members, and extends along the at least one of the vertical members, the top portion is in contact with at least one of the first horizontal members and second horizontal members, and extends along the at least one of the first horizontal members and the second horizontal members, and the bottom portion is in contact with the foundation, and extends along the foundation.

5. The building according to claim 2, wherein:

the opposing side portions are respectively fixed to the two of the vertical members using screws or bolts, and the top portion is fixed to one of the first horizontal members and the second horizontal members using screws or bolts.

6. The building according to claim 2, wherein:

each of the one or more frame members further includes a coupling member, the coupling member connects the opposing side portions together, the coupling member is arranged between the top portion and the bottom portion, and the coupling member extends parallel to the top portion and the bottom portion.

7. A building, comprising:

a foundation;

a building body arranged on the foundation, the building body having a Rahmen structure;

a roof arranged on the building body, the roof having a truss structure; and metal fittings, wherein:

the building body includes:

vertical members;

first horizontal members extending between the vertical members; and second horizontal members extending between the first horizontal members, the second horizontal members intersecting the first horizontal members, the roof includes roof frames and a coupling member that couples the roof frames to each other, at least one roof frame includes:

a roof extending member;

rafters coupled to the roof extending member; and a reinforcement member arranged so as to form the truss structure in an outer frame that is defined by the roof extending member and the rafters, the coupling member that couples the roof frames to each other is fixed to at least one first horizontal member or at least one second horizontal member using at least one metal fitting, the at least one metal fitting includes a fixed portion, two tabs and an attachment portion, the fixed portion is configured to extend away from the coupling member along an upper surface of the at least one first horizontal member or the at least one second horizontal member to which the coupling member is fixed, the fixed portion includes a first edge portion and a second edge portion, and is fixed to the at least one first horizontal member or the at least one second horizontal member to which the coupling member is fixed, the first edge portion includes an inclined portion that is inclined with respect to an extending direction of the at least one first horizontal member or the at least one second horizontal member to which the fixed portion is fixed, the two tabs protrude from the inclined portion of the fixed portion and sandwich the coupling member, a distance between the inclined portion and the second edge portion narrows as a distance from the coupling member sandwiched by the two tabs increases, the attachment portion is configured to extend in one direction from each of the two tabs along the coupling member sandwiched by the two tabs, and at a portion where the coupling member intersects the at least one first horizontal member or the at least one second horizontal member, the at least one metal fitting fixes the coupling member to the at least one first horizontal member or the at least one second horizontal member.

8. The building according to claim 7, wherein:

the building body further includes one or more frame members arranged between two of the vertical members, and each of the one or more frame members with a rectangular frame shape includes a top portion, a bottom portion, and opposing side portions.

9. The building according to claim 8, wherein each of the one or more frame members is formed using dimensional lumber that has a smaller cross-sectional area than the vertical members, the first horizontal members, and the second horizontal members.

10. The building according to claim 8, wherein:

each of the one or more frame members has a space defined by the top portion, the bottom portion, and the opposing side portions, each of the opposing side portions is in contact with at least one of the vertical members, and extends along the at least one of the vertical members, the top portion is in contact with at least one of the first horizontal members and second horizontal members, and extends along the at least one of the first horizontal members and the second horizontal members, and the bottom portion is in contact with the foundation, and extends along the foundation.

11. The building according to claim 8, wherein:

the opposing side portions are respectively fixed to the two of the vertical members using screws or bolts, and the top portion is fixed to one of the first horizontal members and the second horizontal members using screws or bolts.

12. The building according to claim 8, wherein:

each of the one or more frame members further includes a coupling member, the coupling member connects the opposing side portions together, the coupling member is arranged between the top portion and the bottom portion, and the coupling member extends parallel to the top portion and the bottom portion.

13. A method for constructing a building, the method comprising:

forming a foundation;

forming a building body on the foundation, the building body having a Rahmen structure; and coupling pre-assembled roof frames to the building body using metal fittings, the roof having a truss structure, wherein:

the building body includes:

vertical members;

first horizontal members extending between the vertical members; and second horizontal members extending between the first horizontal members, the second horizontal members intersecting the first horizontal members, at least one roof frame includes:

a roof extending member spanning two of the first horizontal members or two of the second horizontal members;

rafters coupled to the roof extending member; and a reinforcement member arranged so as to form the truss structure in an outer frame that is defined by the roof extending member and the rafters, the at least one roof frame is fixed to at least one first horizontal member or at least one second horizontal member using at least one metal fitting, the at least one metal fitting includes a fixed portion, two tabs and an attachment portion, the fixed portion is configured to extend away from the at least one roof frame along an upper surface of the at least one first horizontal member or the at least one second horizontal member to which the at least one roof frame is fixed, the fixed portion includes a first edge portion and a second edge portion, and is fixed to the at least one first horizontal member or the at least one second horizontal member to which the at least one roof frame is fixed, the first edge portion includes an inclined portion that is inclined with respect to an extending direction of the at least one first horizontal member or the at least one second horizontal member to which the fixed portion is fixed, the two tabs protrude from the inclined portion of the fixed portion and sandwich the roof extending member, a distance between the inclined portion and the second edge portion narrows as a distance from the roof extending member sandwiched by the two tabs increases, the attachment portion is configured to extend in one direction from each of the two tabs along the roof extending member sandwiched by the two tabs, and at a portion where the roof extending member intersects the at least one first horizontal member or the at least one second horizontal member, the at least one metal fitting fixes the roof extending member to the at least one first horizontal member or the at least one second horizontal member.

14. The method for constructing a building according to claim 13, further comprising coupling one or more pre-assembled frame members to the building body, wherein each of the one or more pre-assembled frame members with a rectangular frame shape includes a top portion, a bottom portion, and opposing side portions, and the one or more pre-assembled frame members are arranged between two of the vertical members.

15. A method for constructing a building, the method comprising:

forming a foundation;

forming a building body on the foundation, the building body having a Rahmen structure; and coupling pre-assembled roof frames to the building body using metal fittings via a coupling member that couples roof frames to each other, the roof having a truss structure, wherein:

the building body includes:

vertical members;

first horizontal members extending between the vertical members; and second horizontal members extending between the first horizontal members, the second horizontal members intersecting the first horizontal members, at least one roof frame includes:

a roof extending member;

rafters coupled to the roof extending member; and a reinforcement member arranged so as to form the truss structure in an outer frame that is defined by the roof extending member and the rafters, and the coupling member that couples the roof frames to each other is fixed to at least one first horizontal member or at least one second horizontal member using at least one metal fitting, the at least one metal fitting includes a fixed portion, two tabs and an attachment portion, the fixed portion is configured to extend away from the coupling member along an upper surface of the at least one first horizontal member or the at least one second horizontal member to which the coupling member is fixed, the fixed portion includes a first edge portion and a second edge portion, and is fixed to the at least one first horizontal member or the at least one second horizontal member to which the coupling member is fixed, the first edge portion includes an inclined portion that is inclined with respect to an extending direction of the at least one first horizontal member or the at least one second horizontal member to which the fixed portion is fixed, the two tabs protrude from the inclined portion of the fixed portion and sandwich the coupling member, a distance between the inclined portion and the second edge portion narrows as a distance from the coupling member sandwiched by the two tabs increases, the attachment portion is configured to extend in one direction from each of the two tabs along the coupling member sandwiched by the two tabs, and at a portion where the coupling member intersects the at least one first horizontal member or the at least one second horizontal member, the at least one metal fitting fixes the coupling member to the at least one first horizontal member or the at least one second horizontal member.

16. The method for constructing a building according to claim 15, further comprising coupling one or more pre-assembled frame members to the building body, wherein each of the one or more pre-assembled frame members with a rectangular frame shape includes a top portion, a bottom portion, and opposing side portions, and the one or more pre-assembled frame members are arranged between two of the vertical members.

* * * * *